United States Patent [19]

Martelli et al.

[11] 4,286,715

[45] Sep. 1, 1981

[54] RECTANGULAR TRAY FOR PACKING AND CONVEYING SPHEROIDAL FRUIT

[75] Inventors: Nerio Martelli; Giuliano Strazzari, both of Bologna, Italy

[73] Assignee: Nespak S.p.A. Societa Generale Per l'Imballaggio, Massa Lombarda, Italy

[21] Appl. No.: 71,677

[22] Filed: Aug. 31, 1979

[30] Foreign Application Priority Data

Sep. 12, 1978 [IT] Italy ..... 12788 A/78

[51] Int. Cl.[3] ..... B65D 1/34

[52] U.S. Cl. ..... 206/564; 220/238; 220/72; 220/74

[58] Field of Search ..... 220/23.8, 70, 74; 206/564, 557, 558, 565

[56] References Cited

U.S. PATENT DOCUMENTS

| | | | |
|---|---|---|---|
| D. 196,684 | 10/1963 | Weiss | 206/564 |
| 2,422,814 | 6/1947 | Alexander | 206/564 |
| 2,965,226 | 12/1960 | Ettlinger, Jr. | 206/564 |
| 3,369,659 | 2/1968 | Ettlinger, Jr. | 206/564 |
| 3,438,507 | 4/1969 | Kreuger | 206/564 |
| 3,522,877 | 8/1970 | Phillips, Jr. | 206/564 |
| 3,732,976 | 5/1973 | Bessett et al. | 206/564 |
| 3,905,506 | 9/1975 | Florian | 206/564 |
| 4,153,160 | 5/1979 | Leigh | 206/564 |

*Primary Examiner*—Joseph Man-Fu Moy
*Attorney, Agent, or Firm*—Larson and Taylor

[57] ABSTRACT

A rectangular tray for packing and conveying spheroidal fruit, and more particularly for separating layers of fruit lying on top of one another in packing crates. The tray is provided with depressions for accommodating one item of fruit each. The depressions are arranged in rows which are parallel to one side of the tray, adjacent rows being staggered with respect to one another. In order to increase the resistance to bending of the tray with respect to two mutually perpendicular central axes extending parallel to the sides of the tray, in at least some of the rows of depressions at least two depressions in one row are connected together by stiffening channels disposed at an angle to the sides of the tray. The stiffening channels are recessed into one side of the tray and project from the other side of the tray.

20 Claims, 7 Drawing Figures

RECTANGULAR TRAY FOR PACKING AND CONVEYING SPHEROIDAL FRUIT

BACKGROUND OF THE INVENTION

1. Field of the Invention

The invention relates to a rectangular tray for packing and conveying spheroidal fruit, more particularly for separating layers of fruit lying on top of one another.

Such trays must generally be as thin as possible and be as light as possible, and must possess a certain degree of elastic resilience in order to withstand specified pressures in order to avoid damaging the fruit. Accordingly such trays are usually made, for example, of relatively thin-walled foam plastic or paper or cellulose material. At the same time, however, the trays must also be sufficiently stiff so that when a tray which is fully loaded with fruit is gripped in the area of two opposite peripheral edges, for example during loading, and lifted and moved no excessive bending of the tray occurs, particularly to avoid risk of breaking or kinking. The combination of stiffness and low weight, low thickness of the tray, and desired elastic resilience is generally achieved with the use of stiffening channels recessed in the tray.

2. Description of the Prior Art

In known trays of this type the stiffening channels usually extend parallel to one peripheral edge of the tray. As a result, the tray easily bends, thus forming continuous rupture or buckling lines, particularly if the tray is gripped in the area of the two sides of the tray which run parallel to the direction of the stiffening channels and is lifted up. In this known arrangement resistance to bending occurs only in relation to one of the two mutually perpendicular axes of the tray extending parallel to the sides of the tray. That is to say, the tray is strengthened only against bending about the central axis of the tray which is perpendicular to the stiffening channel. As regards the other central axis extending parallel to the said stiffening channel, the risk of rupture and buckling of the tray is even increased by the presence of the stiffening channel. This risk of rupture and buckling is specially high with trays made of foamed polystyrene since this type of plastics material ages relatively quickly and becomes brittle.

It is the object of the invention to eliminate the disadvantages of known designs of tray and to produce a tray for packing and conveying spheroidal fruit in which the stiffening beads produce an increased resistance to bending of the tray about each of the two mutually perpendicular central axes of the tray extending parallel to the sides of the tray.

BRIEF SUMMARY OF THE INVENTION

Accordingly, the present invention provides a rectangular tray for packing and conveying spheroidal fruit, comprising depressions for accommodating one item of fruit each, and stiffening channels recessed into one major surface of the tray and projecting from the other major surface of the tray, the depressions being concave when viewed from the top of the tray and convex from the bottom of the tray, and being arranged in rows which are parallel to one parallel edge of the tray with adjacent rows of depressions being staggered, and wherein in at least some of the rows of depressions at least two depressions in a row are connected together by a said stiffening channel which is disposed at an angle to the peripheral edges of the tray.

In the tray of the present invention, by inclining the stiffening channels with respect to the peripheral edges (i.e. sides) of the tray an effective resistance to bending and buckling of the rectangular tray is achieved in relation to both of the mutually perpendicular central axes of the tray and which extend parallel to the sides of the tray. By arranging these inclined stiffening channels as channels which connect depressions which in each case belong to a given row of depressions, rupture and buckling lines formed by the stiffening channels themselves are avoided since the individual stiffening channels of the different rows of depressions are separated by the channel-free and level tray areas remaining between the rows of depressions. A tray constructed in accordance with the invention and fully loaded with fruit can therefore be held in the area of any two opposite edges and lifted up without risk of rupture or buckling and without any excessive bending. In the present arrangement this greater rigidity and strength of the tray is achieved without increasing the dead weight or wall thickness of the tray.

BRIEF DESCRIPTION OF THE DRAWINGS

The present invention will now be described, by way of example only, with reference to the following drawings, in which.

DETAILED DESCRIPTION

Figure 1:
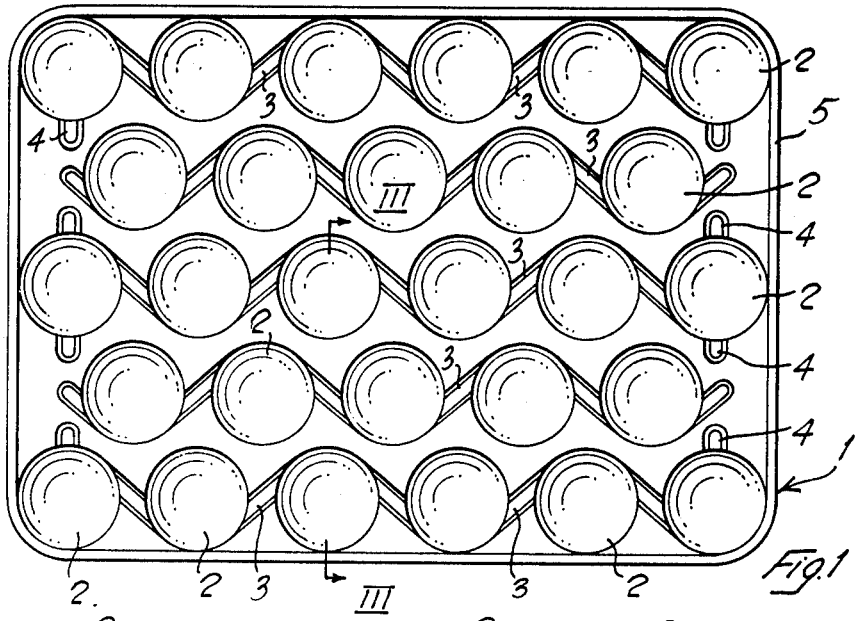
FIG. 1 shows a top view of a tray according to the present invention.

Referring to the drawings, there are shown trays 1 which are designed for packing and conveying spheroidal fruit, for example apples or the like, and particularly for separating layers of fruit lying on top of one another for example in packing crates. The trays are rectangular with rounded corners and preferably also have rounded edges. The trays are generally made of cardboard, paper or cellulose material or of foamed plastics material, preferably foamed polystyrene.

The trays 1 are formed with a number of depressions 2 for accommodating one fruit each. These depressions 2 are concave when viewed from above the tray and convex when viewed from below the tray and have, for example, the shape of a hemisphere or of a calotte. In all illustrative embodiments shown the depressions 2 are arranged in rows which are parallel to one another and to the longer peripheral edges of the tray. The depressions 2 in any one row of depressions are staggered with respect to the depressions 2 in the adjacent rows of depressions.

In addition, the region at the edges of the tray is provided with a stiffening ridge 5 extending around the entire periphery of the tray.

All the trays are also provided with stiffening channels 3, 4, 6 and 7 which are preferably recessed into the top of the tray 1 and project from its bottom in a manner similar to the depressions 2. However, the said channels can also be shaped in the opposite way, that is the stiffening channels 3, 4, 6 and 7 can be recessed into the bottom of the tray and project from its top.

Figure 2:
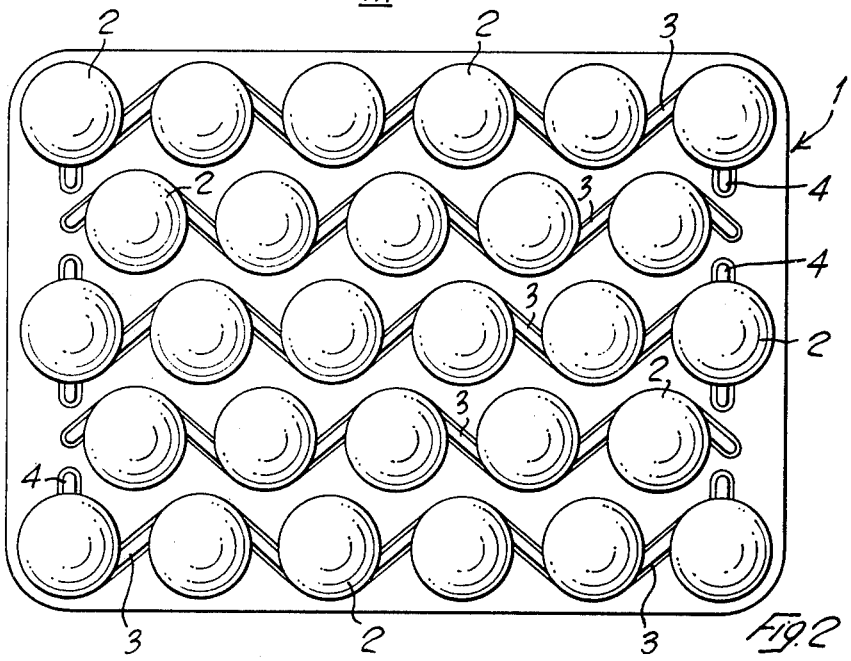
FIG. 2 shows a bottom view of the tray of FIG. 1.
Figure 3:
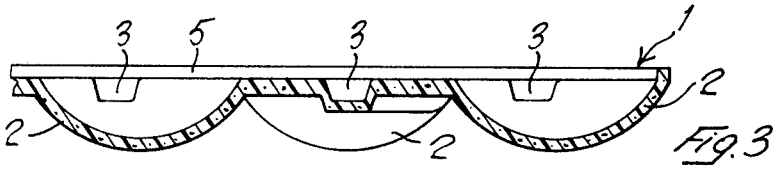
FIG. 3 shows, on an enlarged scale, a vertical partial section taken along line III—III of the tray of FIG. 1.

In detail, in the illustrative embodiment according to FIGS. 1 to 3 the depressions 2 of each row of depressions are connected to one another by stiffening channels 3 which are disposed at an angle, that is are inclined, with respect to both the longer and the shorter peripheral edges of the rectangular tray or to each of the two mutually perpendicular central axes of the tray and extending parallel to the sides of the tray. In this arrangement each alternate stiffening channel 3 in each row of depressions has an inclination opposite to that of the adjacent channels in that row. The angle of inclination of all the stiffening channels 3 in one row of depressions has the same absolute value, that is the stiffening channels 3 have the same inclination except for their direction of inclination with respect to the longitudinal direction of the row of depressions concerned. Each of the rows of depressions 2 in the tray have the same arrangement of inclined stiffening channels 3.

Short stiffening channels 4 can project from depressions 2 located at both ends of the central row and of the two outermost rows of depressions. The short stiffening channels 4 run approximately parallel to the adjacent, shorter peripheral edges of the rectangular tray and therminate at a distance from one another. However, these stiffening channels 4 need not be included. Thus the tray need only be provided with inclined stiffening channels 3 extending between the depressions 2 in each row of depressions.

By arranging the stiffening channels 3 in such an inclined manner a rectangular tray 1 having increased rigidity and resistance to bending in the direction of both the long and the short sides of the tray is obtained. In addition one avoids the formation of continuous rupture and buckling lines because the inclined stiffening channels 3 only connect depressions 2 of the same row of depressions and the stiffening channels 3 of adjacent rows of depressions are separated from one another by intermediate areas which are free of channels.

Figure 4:
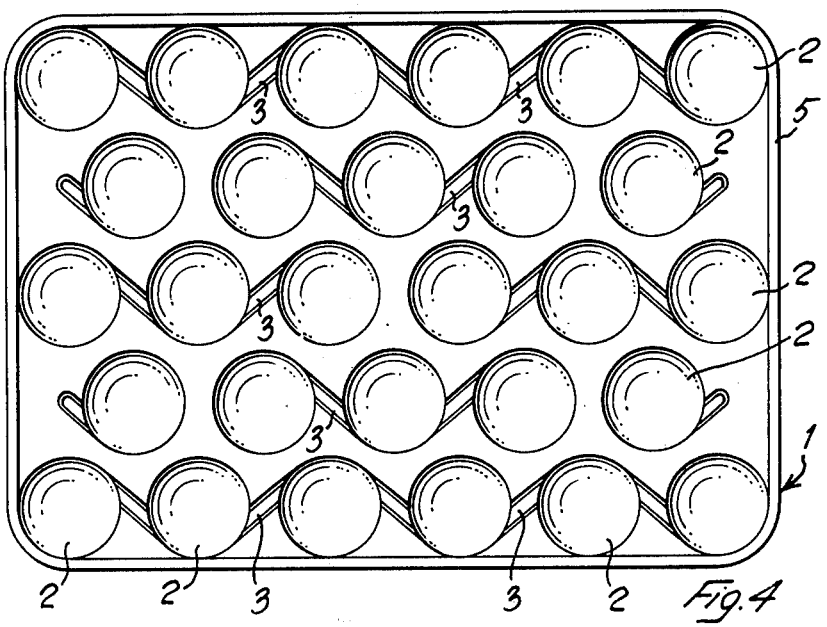
FIGS. 4 to 7 show top views of further embodiments of a tray in accordance with the present invention.

In the embodiment according to FIGS. 1 to 3 each depression 2 in each row is connected by stiffening channels 3 to its nearest neighbouring depressions in that row. In the embodiment of the tray shown in FIG. 4, this only applies to the two outermost rows of depressions. In the remaining intermediate rows of depressions only some of the depressions 2 in each row of depressions are connected by inclined stiffening channels 3 to their neighbouring depressions in that row. In such rows there are no stiffening channels 3 between the remaining depressions 2.

Figure 5:
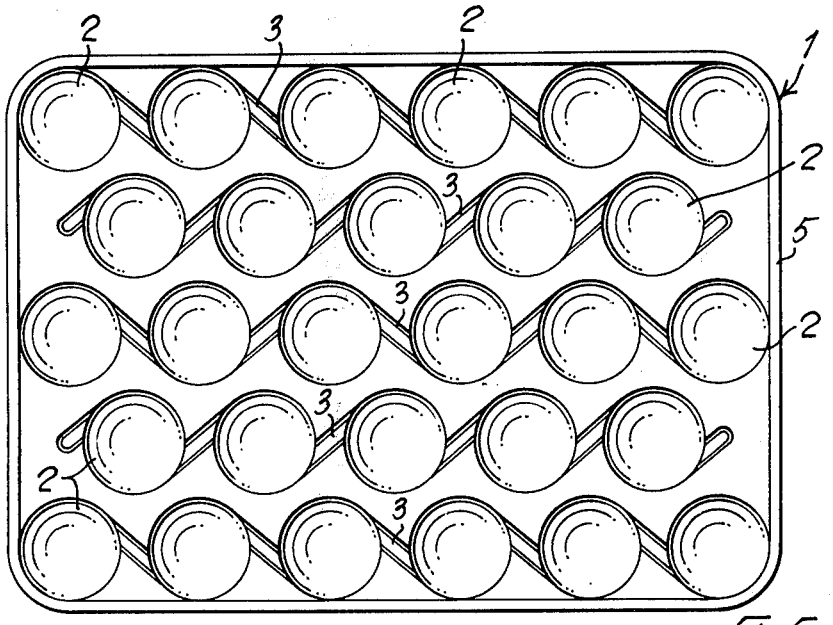

In the illustrative embodiment according to FIG. 5 only the depressions 2 of the central row of depressions are connected to their neighbouring depressions in that row by inclined stiffening channels 3 whose direction of inclination alternates regularly. In every other row of depressions in this embodiment, all the inclined stiffening channels 3 are inclined in the same direction. However, the inclined stiffening channels 3 of the two outermost rows of depressions are inclined in the opposite direction to the inclined stiffening channels 3 of the adjacent rows of depressions. This differing or opposed direction of inclination of the inclined stiffening channels 3 of adjacent rows of depressions achieves a particularly effective stiffening of the tray.

Figure 6:
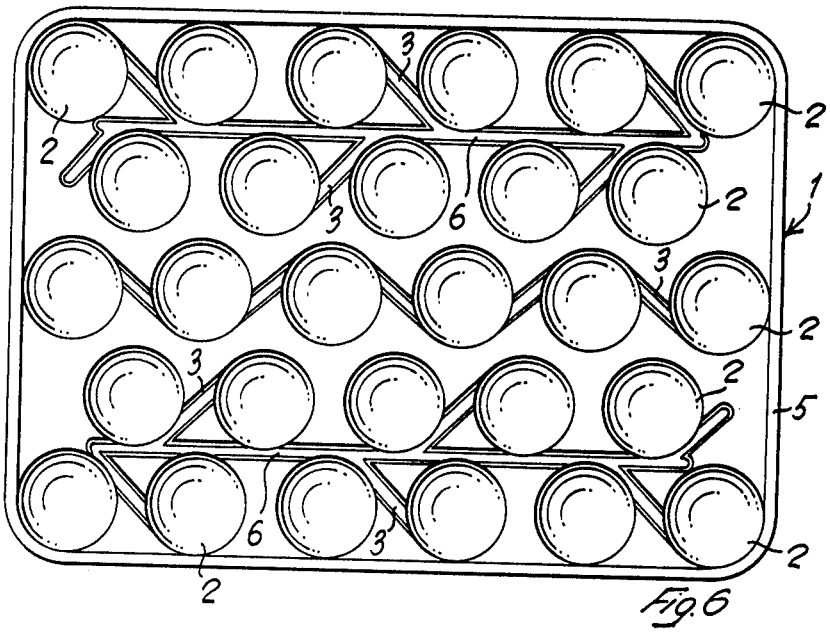

In the embodiment of the tray shown in FIG. 6 the depressions 2 of the centre row of depressions are connected to their neighbouring depressions in that row by inclined stiffening channels 3 which are alternately inclined in opposite directions. On each side of the centre row of depressions between the outermost row of depressions and the row of depressions adjacent to it a stiffening channel 6 is provided which extends in the longitudinal direction of the tray parallel to the rows of depressions, that is parallel to the longer peripheral edge of the rectangular tray. Along the length of each stiffening channel 6 and projecting from each side of each channel 6, there are three stiffening channels 3, each of which mutually connects two depressions 2 of the corresponding adjacent row of depressions. Each longitudinal stiffening channel 6 and the inclined stiffening channels 3 projecting from it forms a herringbone or christmas-tree-like pattern. The inclined stiffening channels 3 projecting from the opposite sides of each longitudinal stiffening channel 6 are displaced one from another.

In the illustrative embodiment shown in FIG. 6 only some depressions 2 of the rows of depressions located on both sides of a longitudinal stiffening channel 6 are connected together in pairs by inclined stiffening channels 3. However, it is quite possible to have an embodiment in which there is a stiffening channel 3 between each and every pair of depressions 2. In addition, the herringbone- or christmas-tree-patterns formed by each longitudinal stiffening channel 6 and associated stiffening channels 3 can be running in the same direction or, as shown in FIG. 6, in opposite directions.

Figure 7:
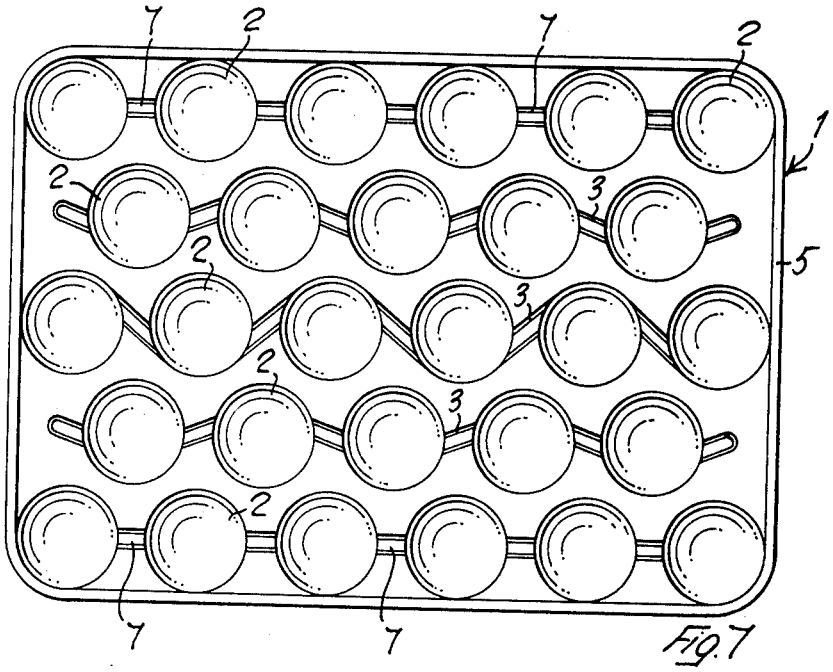

In the illustrative embodiment of the tray shown in FIG. 7 the depressions 2 of the two outermost rows of depressions are mutually connected by stiffening channels 7 which extend in the longitudinal direction of the tray parallel to the rows of depressions, (i.e. parallel to the longer peripheral edge of the rectangular tray). The depressions 2 of the remaining rows of depressions are mutually connected by inclined stiffening channels 3. In this embodiment the angles of inclination of the inclined stiffening channels 3 of two adjacent rows of depressions have absolute values of different magnitude, independently of the direction of inclination of the stiffening channels 3 with respect to the longitudinal direction of the rows of depressions. In particular, the inclined stiffening channels 3 of the central row of depressions are more inclined to the longitudinal direction of the row of depressions than the inclined stiffening channels 3 of the two rows of depressions adjacent thereto. Thus the inclination of the inclined stiffening channels 3 with respect to the longer sides of the tray progressively decreases from the central row of depressions to both sides until there is no inclination in the outermost rows of depressions, that is until the inclined stiffening channels 3 are replaced by stiffening channels 7 which extend longitudinally between the depressions 2.

In the illustrative embodiment according to FIG. 7 each alternate stiffening channel 3 in each row of depressions has an inclination opposite to that of the adjacent channel in that row. The feature of the varying degree of inclination of the inclined stiffening channels 3 of two adjacent rows of depressions can be used, of course, also if the inclined stiffening channels 3 of each individual row of depressions are inclined in the same direction, that is are parallel with respect to one another. In addition, the feature of the varying degree of inclination of the inclined stiffening channels 3 can also be applied to the stiffening channels 3 of each individual row of depressions, that is the inclined stiffening channels 3 between the depressions 2 in one and the same row of depressions can have angles of inclination with differing absolute values, independently of their direction of inclination with respect to the longitudinal direction of the row of depressions concerned.

In all illustrative embodiments shown or described the bending or buckling strength of the tray can be increased further by adhering or sealing to the bottom of the tray and also, if desired, to the top of the tray a thin, tough and preferably thermoplastic layer having a low coefficient of elasticity. Such a layer takes up the forces arising on bending of the tray and has a reinforcing effect similar to steel reinforcements in reinforced concrete.

What is claimed is:

1. A rectangular tray formed of a thin-walled material of essentially uniform thickness for packing and conveying generally spheroidal objects, comprising, depressions for accommodating one object each, and stiffening channels recessed into one major surface of the tray and projecting from the other major surface of the tray, the depressions being concave when viewed from the top of the tray and convex from the bottom of the tray, and being arranged in straight rows which are parallel to one peripheral edge of the tray with the depressions in each row being staggered relative to the depressions in adjacent rows, and wherein in at least some of the rows of depressions the majority of depressions are connected to adjacent depressions by said stiffening channels which are disposed at an oblique angle to the direction of that row, whereby buckling of the tray is resisted along lines parallel to the peripheral edges of the tray.

2. A tray according to claim 1, wherein the inclined stiffening channels in any one row of depressions are inclined in the same relative direction.

3. A tray according to claim 1, wherein some of the inclined stiffening channels in any one row of depressions is inclined in one direction and some of the inclined stiffening channels of that row are inclined in the opposite direction.

4. A tray according to claim 3, wherein each alternate inclined stiffening channel in said one row of depressions is inclined in a direction opposite to the direction of inclination of the adjacent stiffening channel.

5. A tray according to any one of claims 1 to 4, wherein the inclined stiffening channels of two adjacent rows of depressions are inclined in the same direction.

6. A tray according to any one of claims 1 to 4, wherein the inclined stiffening channels in one of two adjacent rows of depressions are inclined in a direction opposite to the inclination of the stiffening channels in the other row.

7. A tray according to any one of claims 1 to 4, wherein the angles of inclination of the inclined stiffening channels in any one row of depressions have the same absolute value, independently of the direction of inclination of the channels with respect to the longitudinal direction of the row of depressions.

8. A tray according to any one of claims 1 to 4, wherein the angles of inclination of the inclined stiffening channels in any one row of depressions have different absolute values, independently of the direction of inclination of the channels with respect to the longitudinal direction of the row of depressions.

9. A tray according to any one of claims 1 to 4, wherein the angles of inclination of the inclined stiffening channels in two adjacent rows of depressions have the same absolute value, independently of the direction of inclination of the channels with respect to the longitudinal direction of the rows of depressions.

10. A tray according to any one of claims 1 to 4, wherein the angles of inclination of the inclined stiffening channels in two adjacent rows of depressions have differing absolute values, independently of the direction of inclination of the channels with respect to the longitudinal direction of the rows of depressions.

11. A tray according to claim 1, wherein additional stiffening channels running parallel to at least one peripheral edge of the tray are provided.

12. A tray according to claim 11, comprising at least one stiffening channel running parallel to and between two adjacent rows of depressions, and inclined stiffening channels projecting from the said at least one stiffening channel in a herring-bone or christmas tree pattern, each of the inclined stiffening channels connecting together two depressions of a row of depressions adjacent the said at least one stiffening channel.

13. A tray according to claim 11, wherein the depressions of at least one row of depressions are connected by inclined stiffening channels and the depressions of at least one other row of depressions are connected totgether by stiffening channels which extend parallel to the longitudinal direction of the row of depressions.

14. A tray according to claim 11, wherein at least two depressions in a row of depressions are connected by inclined stiffening channels and at least two depressions of the same row of depressions are connected together by stiffening channels which extend parallel to the longitudinal direction of the row of depressions.

15. A tray according to claim 11, wherein the additional stiffening channels extend from the depressions at the ends of at least one row of depressions.

16. A tray according to claims 1 to 4, and 11 to 15 wherein the rows of depressions extend parallel to the longer peripheral edge of the tray.

17. A tray according to any one of claims 1 to 4, and 11 to 15 wherein a stiffening ridge projecting upward and extending around the whole tray is provided at the edge region of the tray.

18. A tray according to claim 1, wherein the tray is formed of a foamed plastics material.

19. A tray according to claim 18, wherein the tray is formed of foamed polystyrene.

20. A tray according to claims 1 to 4, 11 to 15, 18 and 19, wherein the tray is covered at least on its underside with a layer of tough, preferably thermoplastic, material having a low coefficient of elasticity, the material being adhered or sealed to the tray.

* * * * *